US005770827A

United States Patent [19]

Maki

[11] Patent Number: 5,770,827

[45] Date of Patent: Jun. 23, 1998

[54] CIRCUIT BREAKER MAGNETIC BLOWOUT ARC EXTINGUISHING DEVICE WITH ARC RUNNER FEATURES

[75] Inventor: Kazuyoshi Maki, Saga-ken, Japan

[73] Assignee: Togami Electric Mfg. Co., Ltd., Japan

[21] Appl. No.: 633,208

[22] Filed: Apr. 16, 1996

[30] Foreign Application Priority Data

Apr. 28, 1995 [JP] Japan ..... 7-129295

[51] Int. Cl.[6] ..... H01H 33/18; H01H 9/44; H01H 73/18

[52] U.S. Cl. ..... 218/22; 218/40; 218/148

[58] Field of Search ..... 218/22–40, 146, 218/148, 57–67

[56] References Cited

U.S. PATENT DOCUMENTS

| | | | |
|---|---|---|---|
| 4,249,051 | 2/1981 | Votta | 218/29 |
| 4,259,554 | 3/1981 | Smith et al. | 218/29 |
| 4,410,778 | 10/1983 | Weston | 218/57 |
| 4,529,853 | 7/1985 | Bouilliez | 218/23 X |
| 4,743,719 | 5/1988 | Spooner | 218/29 |
| 4,980,527 | 12/1990 | Eppinger | 218/29 |
| 5,003,138 | 3/1991 | Bolongeat-Mobleu et al. | 218/26 |
| 5,015,810 | 5/1991 | Eppinger et al. | 218/29 |
| 5,464,956 | 11/1995 | Steele et al. | 218/23 |

*Primary Examiner*—J. R. Scott
*Attorney, Agent, or Firm*—Ronald P. Kananen

[57] ABSTRACT

There is provided an acr extinguishing device of a circuit breaker which closes and opens an electric line, one of two contact parts being fixed to a base part. The arc extinguishing device includes an arc runner formed of an electrically conductive member and arranged on an outer circumference of the above one of the two contact parts. The arc extinguishing device moves, to the arc runner, an arc occurring when a contact made by the two contact parts is opened whereby the arc is extinguished. The arc runner has a cylindrical shape and includes a rising portion formed on an entire inner circumference of the cylindrical shape. A slant angle of the rising portion obtained on a depth side thereof is greater than another slant angle thereof obtained on a front side thereof.

7 Claims, 6 Drawing Sheets

CIRCUIT BREAKER MAGNETIC BLOWOUT ARC EXTINGUISHING DEVICE WITH ARC RUNNER FEATURES

BACKGROUND OF THE INVENTION

1. Field of the Invention

The present invention relates to an arc extinguishing device of a circuit breaker in which the extinguishing device is arranged on an outer circumference of contact members of the circuit breaker. More particularly, the present invention is concerned with an arc extinguishing device of a circuit breaker having an improvement in the shape of an arc runner.

2. Description of the Prior Art

There is a conventional arc extinguishing device of a circuit breaker of the above type shown in FIG. 1, which is a detailed cross-sectional view thereof. Referring to this figure, the arc extinguishing device of the circuit breaker includes an arc runner 10, a coil bobbin 2, a driving coil 30, an insulating part 4, and a flange attachment part 50. The arc runner 10 is formed of an electrically conductive member having a substantially cylindrical shape. The arc runner 10 moves the discharging position of an arc from an inner surface of the substantially cylindrical shape. The coil bobbin 2 is formed of an electrically conductive member having a substantially cylindrical shape, and supports the arc runner 10 at its front end portion of the substantially cylindrical shape. The driving coil 30 is arranged on the outer circumference of the cylindrical shape of the coil bobbin 2, and generates a magnetic field in the arc runner 10. The insulating part 4 is formed of a cylindrical body having insulation, and supports the coil bobbin 2 at an end of the cylindrical body. The flange attachment part 50 includes a flange main body 51, which has a cylindrical shape and a female screw 54 formed on the inner side thereof. A mail thread 101 of a stationary contact part 100 is screwed to the female screw 54 of the flange main body 51. The flange attachment part 50 supports the insulating part 4 at an end of the flange main body 51.

The above arc runner 10 has a runner main body 13 and runner attachment screws 12. The runner main body 13 has a shape like a watering pot which has an identical diameter in the range of a depth side along the inner surface of the cylindrical shape made of an electrically conductive member to an intermediate position thereon. The runner attachment screws 12 attach a flange portion formed so as to outwardly project from the outer circumference of the runner main body 13 to the coil bobbin 2 located on the back side of the flange portion. The coil bobbin 2 is made up of a bobbin main body 21 and an accommodating portion 22. The bobbin main body 21 is formed of a hollow cylindrical member made of an electrically conductive member. The accommodating portion 22 accommodates the driving coil 30 in a step portion formed on the outer circumference of the bobbin main body 21, the: above step portion having a rectangular cross section.

The driving coil 30 is disposed closely in a recess portion defined by the accommodating portion 22 and the flange portion of the runner main body 13. The driving coil 30 has a protection member 32*a*, a winding 34 and an outer tube 35. The protection member 32*a* is a circular ring member which has a substantially L-shaped cross section and is made of an insulating substance such as resin. The winding 34 is placed in the protection member 32*a* and is formed by winding a copper wire having a circular cross section in a three-layer formation. The outer pipe 35 is wound about the outer circumference of the winding 34. Spaces between the turns of the winding 34 are full of an epoxy resin (an illustration thereof is omitted), whereby the driving coil 30 is fixed to the above recess portion. The winding 34 is configured so that an insulating sheet (an illustration thereof is omitted) is interposed between the adjacent turns of the winding 34 formed in the three-layer formation.

A description will now be given of ail arc extinguishing operation of the conventional arc extinguishing device of the circuit breaker having the above-mentioned structure.

A current is supplied from a power-supply-side conductor 100 of a stationary contact part 100 to a stationary-side base 105 and is then supplied to stationary contact members 102 from the stationary-side base 105 in a state in which a movable contact member 201 engages the stationary contact members 102 arranged in a tulip formation. Thus, the current is supplied to the movable contact member 201 engaged with the stationary contact members 102.

In a shift from the above closed state to an open state, an arc takes place at the time when the movable contact member 201 starts to move toward a disengagement from the stationary contact members 102, and is then detached therefrom. When the distance between the movable contact member 201 and the stationary contact members 102 increases and the movable contact member 201 becomes close to the inner wall surface of the runner main body 13 of the arc runner 10, an arc shifts to the space between the arc runner 10 and the movable contact member 201.

When the arc with respect to the arc runner 10 occurs, a current resulting from the arc flows in the winding 34 of the driving coil 30, which generates the magnetic field. The electromagnetic force takes place in the direction perpendicular to the magnetic field, and operates on the arc. Thus, the arc is moved on the arc runner 10, so that extinguishment of the arc can be facilitated.

Since the conventional arc extinguishing device of the circuit breaker is configured as, described above, it is difficult-to smoothly move the arc occurring between the stationary contact members 102 of the stationary contact part 100 and the movable contact member 201 from the stationary contact members 102 to the arc runner 10, so that the arc cannot be extinguished rapidly and certainly. In order to certainly perform the art extinguishing operation, it is necessary to ensure a sufficient insulation distance. This increases the size of the device itself.

In the conventional arc extinguishing device of the circuit breaker, the relative arrangement of the arc runner 10 and the stationary contact members 102 and the relative arrangement of the arc runner 10 and the movable contact member 201 are not considered at all Hence, these parts are allowed to independently operate, and thus the extinguishment of the arc cannot be satisfactorily facilitated. If the arc cannot be sufficiently extinguished, the arc may damage the arc runner 10, the stationary contact members 102 and/or the movable contact member 201. This reduces the lifetime of the device.

SUMMARY OF THE INVENTION

It is a general object of the present invention to provide a circuit breaker in which the above problems are eliminated.

A more specific object of the present invention is to provide an arc extinguishing device of a circuit breaker capable of rapidly and certainly performing an arc extinguishing operation.

The above objects of the present invention are achieved by an arc extinguishing device of a circuit breaker which closes and opens an electric line, in which one of two contact parts is fixed to a base part. The arc extinguishing device comprises an arc runner formed of an electrically conductive member and arranged on an outer circumference of the above one of the two contact parts, the arc extinguishing device moving, to the arc runner, an arc occurring when a contact made by the two contact parts is opened whereby the arc is extinguished. The arc runner has a cylindrical shape and includes a rising portion formed on an entire inner circumference of the cylindrical shape. A slant angle of the rising portion obtained on a depth side thereof is greater than another slant angle thereof obtained on a front side thereof. According to the above structure, it is possible to certainly alter the arc occurring between the two contact parts to an arc occurring between the arc runner and the other one of the two contact parts. Hence, the arc can be certainly extinguished more rapidly.

The arc extinguishing device may comprise a coil bobbin and a driving coil. The coil bobbin is arranged on the above one of the two contact parts through an insulating cylindrical body and is formed of a cylindrical member of an electrically conductive member. The driving coil is arranged on an outer circumference of the coil bobbin, and an end of a winding is connected to the base of the above one of the two contact parts, another end thereof being connected to the arc runner. A distance between the above one of the two contact parts and the arc runner is shorter than a distance between the above one of the two contact parts and an inner wall of the coil bobbin. According to the above structure, it is possible to facilitate shifting of the arc toward the arc runner.

A distance between a top of the rising portion of the arc runner and the other one of the two contact parts located in the cylindrical body of the arc runner when the contact made by the two contact parts is closed or opened may be shorter than the distance between the above one of the two contact parts and the arc runner. According to the above structure, it is possible to facilitate shifting of the art toward the arc runner.

The arc runner may have a corner located on a side of an outer circumference thereof. The above corner prevents the arc from being spread. Particularly, when a plurality of phases are serially disposed, the intervals can be reduced and down-sizing of the device can be achieved.

A front slant of the arc runner defined by the rising portion may be parallel to a direction of a magnetic flux generated by the driving coil. Hence, it is possible to operate the maximum electromagnetic force in the direction perpendicular to the arc of the arc runner.

The above one of the two contact parts may comprise contact members arranged in a tulip formation so as to form a hollow cylindrical shape. The arc extinguishing device may further comprise a central guide part arranged in the hollow cylindrical shape of the above one of the two contact parts and attached to the base of the above one of the two contact parts, the central guide part being formed of a magnetic member coated by an insulating member. Hence, it is possible to certainly perform the closing and opening operations and concentrate the magnetic flux generated by the driving coil on the magnetic central guide part. As a result, the arc can be smoothly guided toward the central guide part from the other contact part.

The central guide part may comprise a conical shape located at an end thereof, and the conical shape may have a slant surface to which a line parallel to a front slant of the arc runner defined by the rising portion. Hence, it is possible to more certainly draw the magnetic field generated by the driving coil toward the central guide part and to thus perform the arc extinguishing function more certainly.

BRIEF DESCRIPTION OF THE DRAWINGS

The nature, utility, and further features of the present invention will be more clearly apparent from the following detailed description with respect to preferred embodiments of the invention when read in conjunction with the accompanying drawings briefly described below.

DESCRIPTION OF THE PREFERRED EMBODIMENTS (An Embodiment of the Present Invention)

Figure 2:
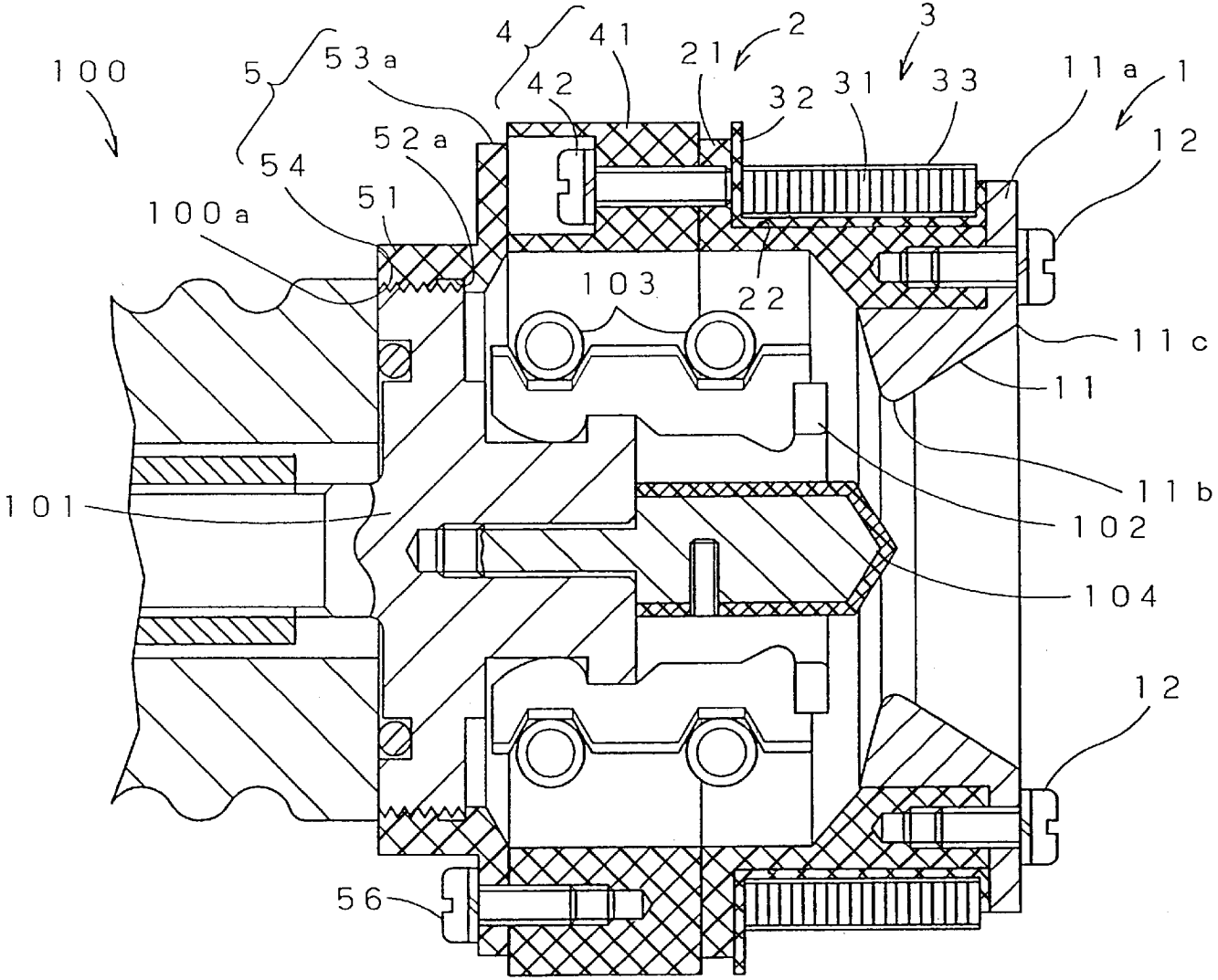
FIG. 2 is a detailed cross-sectional view of an arc extinguishing device of a circuit breaker according to an embodiment of the present invention.
Figure 3:
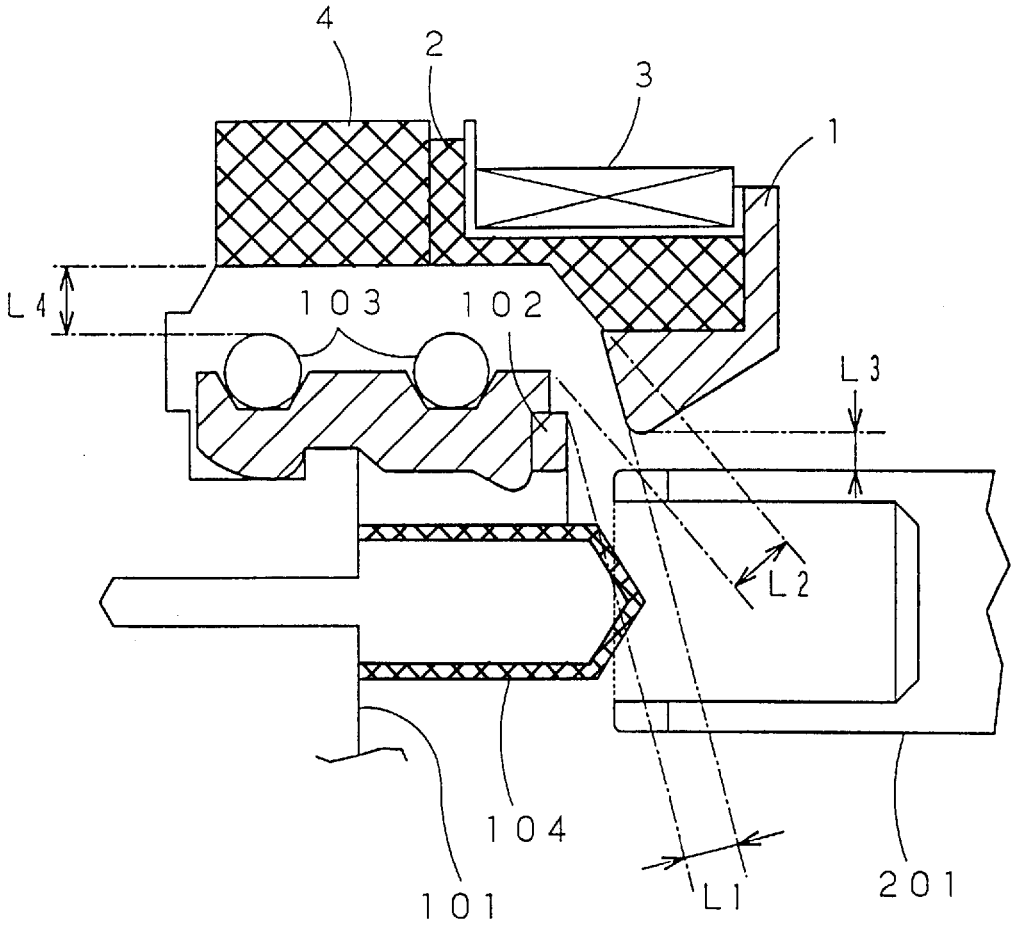
FIG. 3 is a diagram of an arrangement of components of the arc extinguishing device of the circuit breaker shown in FIG. 2.
Figure 4:
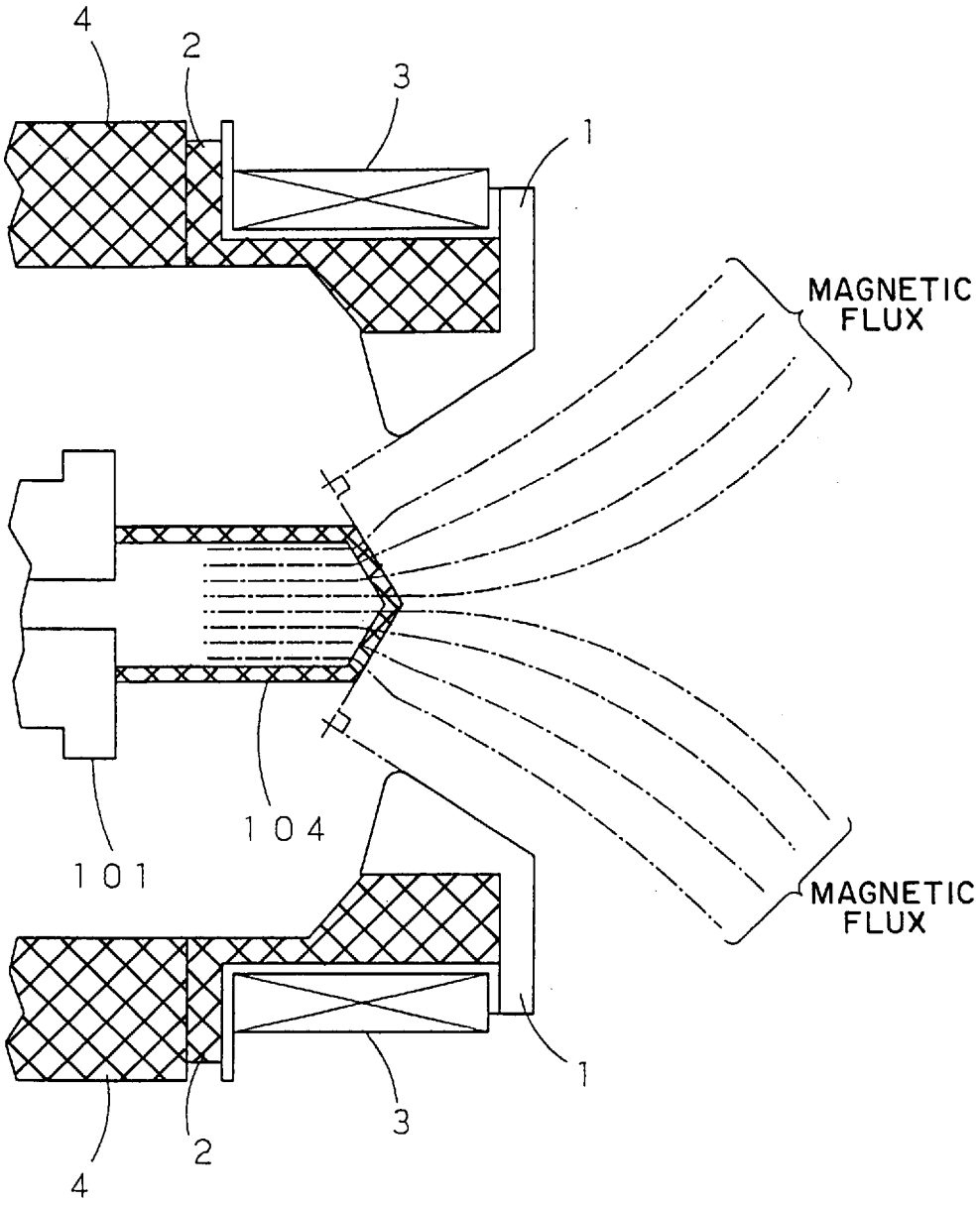
FIG. 4 is a diagram of an arrangement of an arc runner and a central guide part of the arc extinguishing device of the circuit breaker shown in FIG. 2.

A description will now be given, with reference to FIGS. 2 through 4, of an arc extinguishing device of a circuit breaker according to an embodiment of the present invention. FIG. 2 is a detailed cross-sectional sectional view of the arc extinguishing device according to the present embodiment, FIG. 3 is a diagram showing an arrangement of parts of the arc extinguishing device of the circuit breaker shown in FIG. 2, and FIG. 4 is a diagram explaining a relation between an arc runner of the arc extinguishing device of the circuit breaker shown in FIG. 2 and a central guide part thereof.

Figure 1:
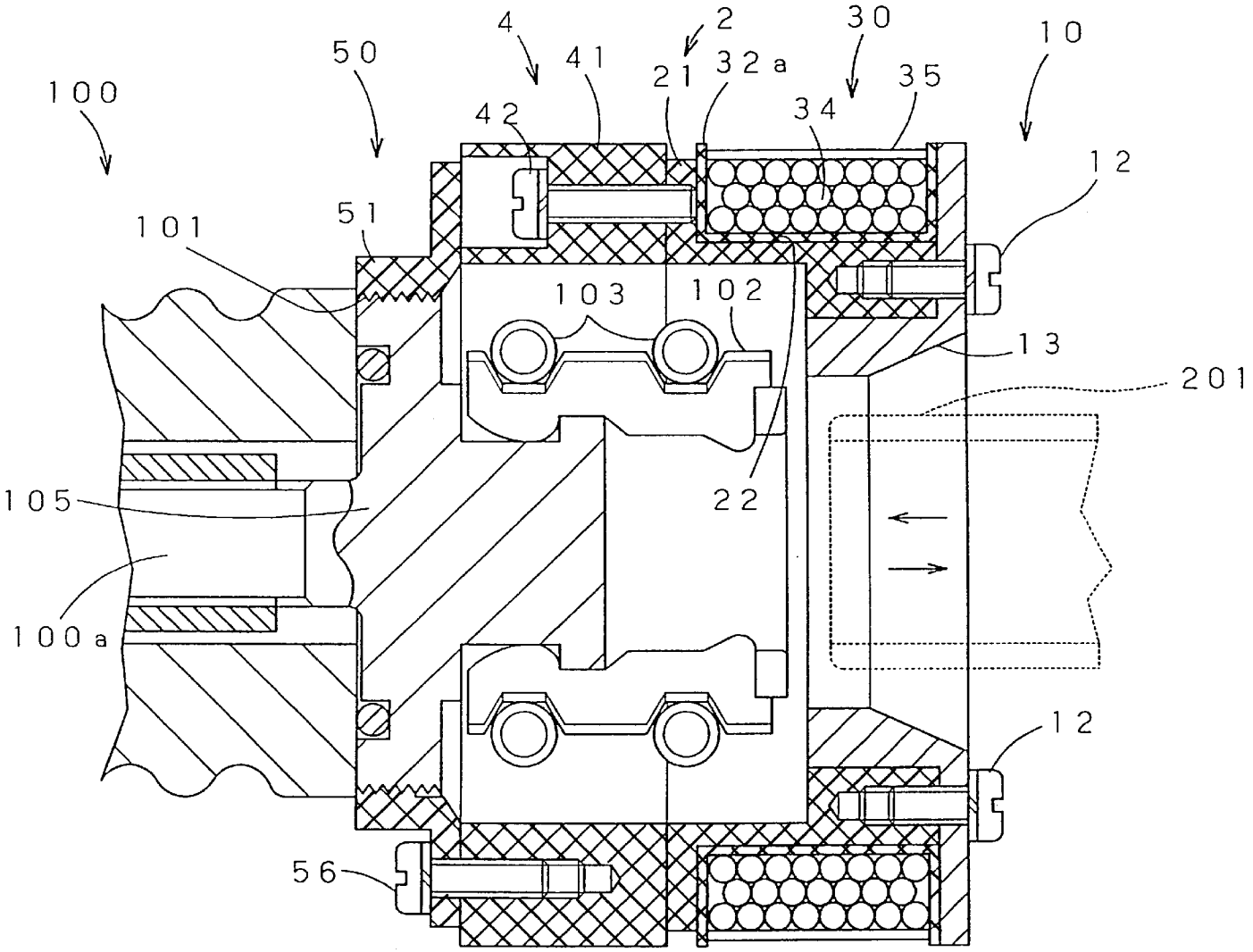
Fig. 1 PRIOR ART
FIG. 1 is a detailed cross-sectional view of a conventional arc extinguishing device of a circuit breaker.

Referring to these figures, the arc extinguishing device of the circuit breaker according to the present embodiment has, as in the case of the conventional one shown in FIG. 1, an arc runner 1 (which corresponds to the reference number 10 shown in FIG. 1), the coil 2, the) driving coil 3 (which corresponds to the reference number 30 shown in FIG. 1), the insulating part 4, and a flange attachment part 5 (which corresponds to the reference number 50 shown in FIG. 1), these components being assembled in the same way as those of the conventional device. The present arc extinguishing device differs from the conventional one in the structures of the arc runner 1 and driving coil 3.

The arc runner 1 includes a runner main body 11, and runner attachment screws 12. The runner main body 11 has an orifice shape defined as follows. The orifice shape has an inwardly rising portion 11*b*, which is located slightly deeply with respect to the intermediate position on the inner surface of a cylindrical shape made of an electrically conductive member of the arc runner 1 and is formed on the entire inner circumference of the cylindrical shape. The slant angle of the rising portion 11*b* on the depth side thereof is greater than the slant angle thereof on the front side thereof. The runner attachment screws 12 fasten the runner main body 11 to the coil bobbin 2. The above-mentioned driving coil 3 is disposed closely in a recess portion defined by the accommodating portion 22 and a flange portion 11*a* of the runner main body 11. The driving coil 3 has a protection member 32, a winding 31 and a cohesive tape 33. The protection member 32 is a circular ring member which has a substantially L-shaped cross section and is made of an insulating substance such as resin. The winding 31 is placed in the protection member 32 and is formed by winding a flat and rectangular copper wire having a rectangular cross section in a single-layer formation. An insulating coat film is provided on the surface of the protection member 32. The cohesive tape 33 is wound on the winding 31.

An arc stopper portion 11*c* having a corner is provided at the joint portion of an end portion of the front-side slant surface of the rising portion 11*b* and an end of the flange portion 11*a* in the arc runner 1. The rising portion 11*b* of the arc runner 1 is defined so as to be a wall surface substantially parallel to the direction of the magnetic flux generated by the driving coil 3.

The aforementioned stationary contact part 100 has a tulip formation in which a plurality of stationary contact members 102 are circularly arranged at the front end portion thereof so as to form a ring of the contact members 102. A central guide part 104 is screwed to a screw hole of an attachment baste 101. The central guide part 104 has a magnetic cylindrical body having a tip end of a conical shape. The surface of the cylindrical body is coated by an insulating member.

The arrangement relation between the arc runner 1 and the stationary contact part 100 is as shown in FIG. 3. More particularly, the minimum distance L1 between the rising portion 11*b* of the runner main body 11 of the arc runner 1 and the stationary contact member 102 is shorter than the minimum distance between the above stationary contact member 102 and the inner surface of the coil bobbin 2 (L1<L2). The minimum distance L2 between the stationary contact member 102 and the inner surface of the coil bobbin 2 is shorter than the minimum distance L4 between the inner wall of the coil bobbin 2 (or the inner wall of the insulating part 4) and a garter spring 103 (L2<L4) in the open state.

The relation between the arc runner 1 and a movable contact part 200 is defined so that the minimum distance L3 between the rising portion 11*b* of the runner main body 11 of the arc runner 1 and the movable contact member 201 which is moving is shorter than the minimum distance L1 between the rising portion 11*b* and the stationary contact member 102 (L3<L1).

A description will now be given of an arc extinguishing operation of the arc extinguishing device having the above structure.

First, as in the case of the conventional device shown in FIG. 1, the device is switched to the open state from the closed state in which the stationary contact members 102 engage the movable contact member 201 and a current is supplied to the movable contact member 201. An arc takes place at the time when the movable contact member 201 starts toward a disengagement from the stationary contact members 102, and is then detached therefrom. The above initial arc occurs between anti-arc contact pieces of the stationary contact members 102 and an anti-arc contact piece of the movable contact member 201. When the movable contact member 201 becomes further away from the stationary contact members 102, an arc takes place between the rising portion 11*b* of the arc runner 1 and the movable contact member 201. A current due to the arc flows in the driving coil 3 connected to the arc runner 1 and the flange attachment part 5, so that the driving coil 3 is magnetized and the magnetic field is generated.

When the movable contact member 201 is further away from the stationary contact members 102, the arc between the arc runner 1 and the movable contact member 201 rides over the rising portion 11*b* of the arc runner 1 and then shifts to the front slant surface thereof. After the arc shifts to the front slant surface, the electromagnetic force due to the magnetic field of the driving coil 3 directed in the direction perpendicular to the front slant surface operates on the arc, so that a magnetic blow-out function can be effected.

When the distance between the movable contact member 201 and the arc runner 1 is much more increased, the arc forwardly shifts along the front slant surface and is then prevented from moving toward the side by means of the arc stopper portion 11*c* formed at the end of the front slant surface. That is, since the arc stopper portion 11*c* has the corner, the arc is prevented from being outwardly spread and is rather expanded. In this way, the arc is extinguished.

When the driving coil 3 is magnetized and the magnetic force is thus generated, the magnetic flux is distributed in parallel with the front slant of the arc runner 1. The magnetic flux parallel to the front slant perpendicularly passes through the front end of the central guide part 104 made of a magnetic member, and is concentrated thereon. By concentrating the magnetic flux on the front end of the central guide part 104, it becomes possible to draw the arc generated between the arc runner 1 and the movable contact member 201 toward the central guide part 104 and to effectively prevent the anti-arc contact pieces of the stationary contact members 102 from being damaged. Since the central guide part 104 made of a magnetic material is coated by an insulating member, the arc can be magnetically drawn and a discharge does not take place.

Figure 5:
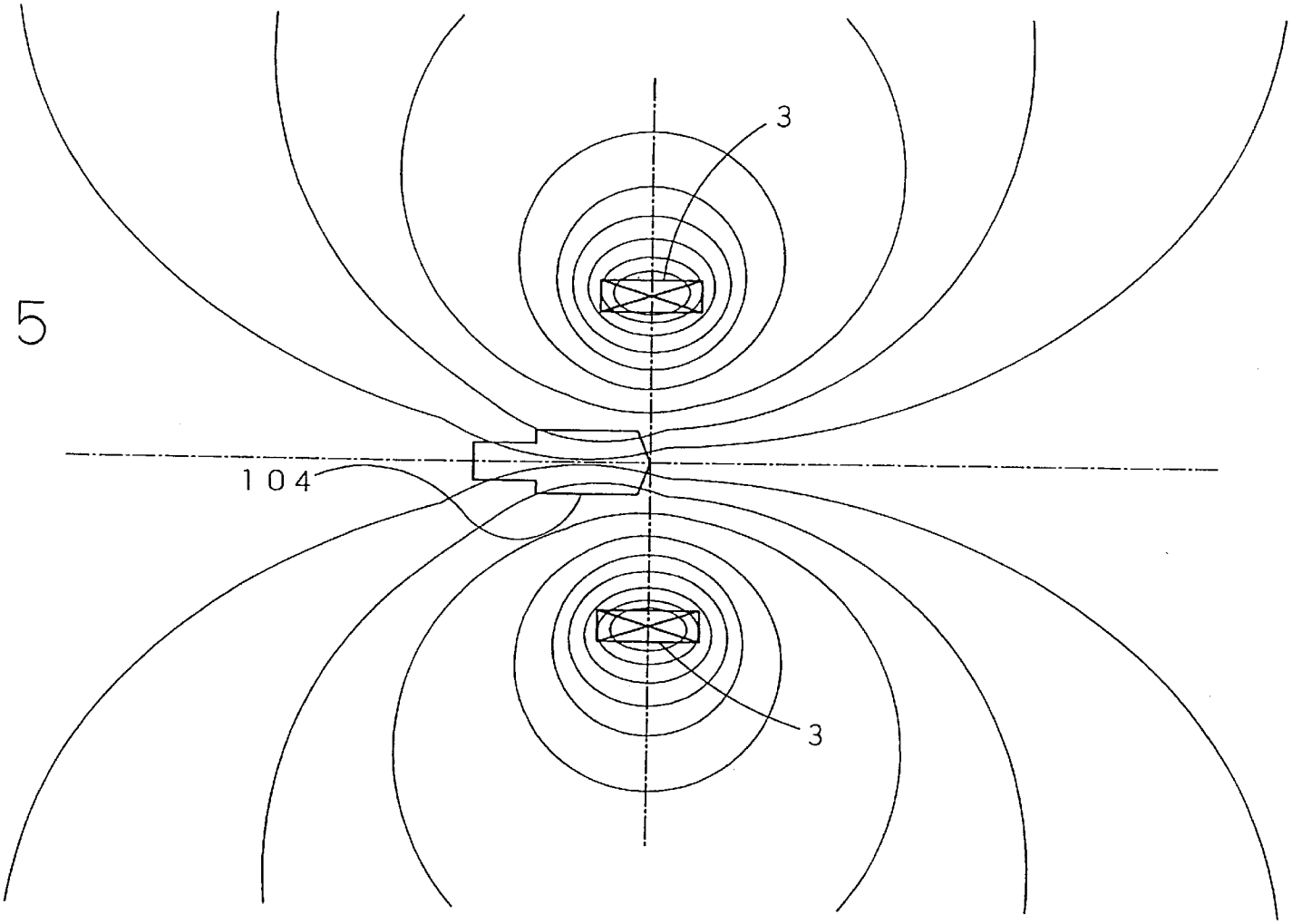
FIG. 5 is a diagram showing a magnetic field performance of the driving coil and the central guide part of the arc extinguishing device of the circuit breaker shown in FIG. 2.
Figure 6:
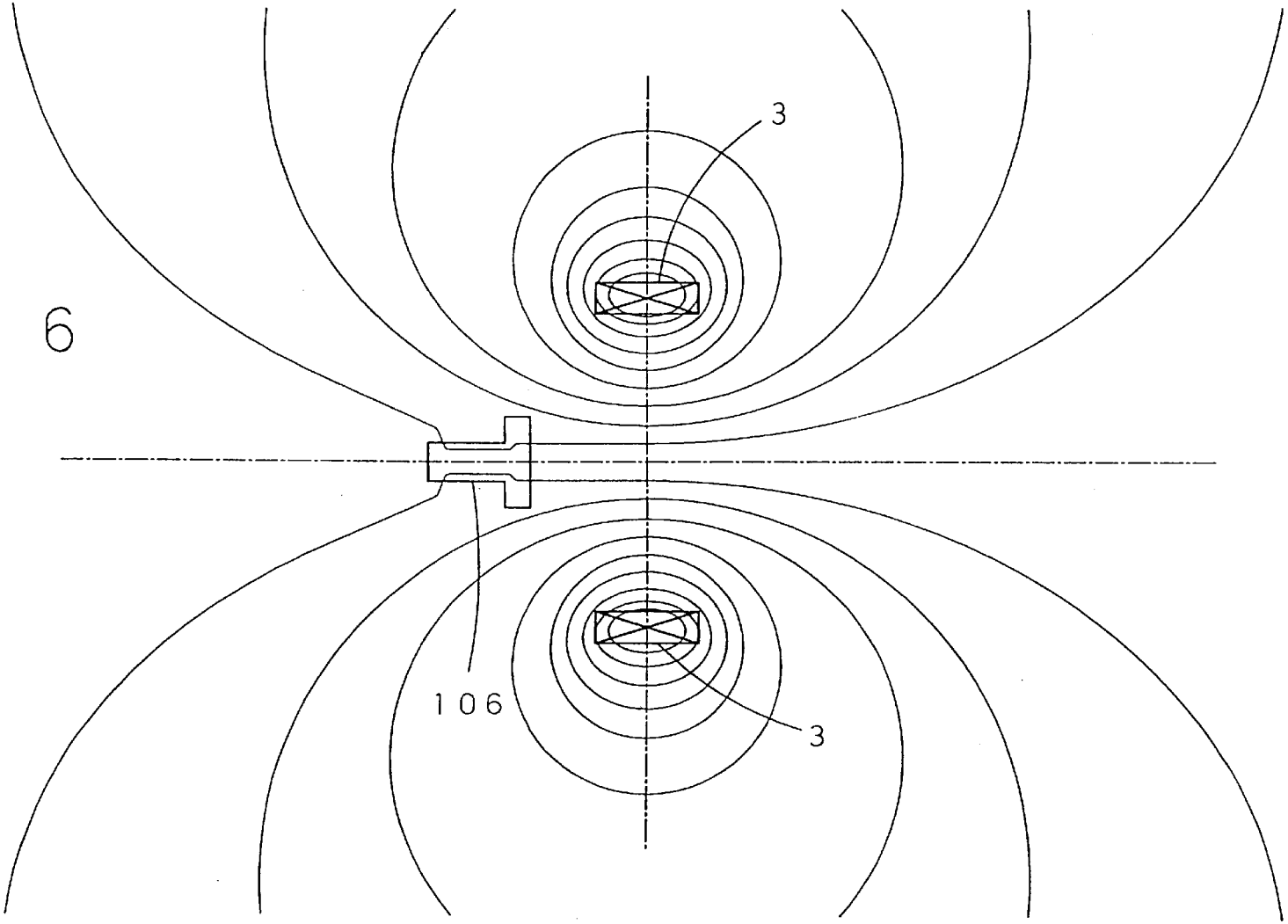
FIG. 6 is a diagram showing a magnetic field performance of a driving coil and a central guide part of a conventional arc extinguishing device of a circuit breaker.

The front end portion of the central guide part 104 has a conical shape having a slant surface which is perpendicular to a line parallel to the front slant surface of the arc runner 1, so that the magnetic flux density can be increased. The magnetic field performance related to the driving coil 3 and the central guide part 104 obtained in the present embodiment is depicted in FIGS. 5 and 6. In both cases of FIGS. 5 and 6, the magnetic flux is concentrated on in the center portion, as compared with the inside of the arc runner 1.

Next, a description will be given of an operation in which the arc initially occurring between the stationary contact members 102 and the movable contact member 201 is moved toward the arc runner 1 during the process of shifting from the closed state to the open state. The distance L2 between the stationary contact members 102 and the inner surface of the coil bobbin 2 is shorter than the distance L4 between the garter spring 103 loaded to the outer of the stationary contact members 102 and the inner surface of the coil bobbin 2. Hence, the arc taking place between the stationary contact members 102 and the movable contact member 201 can be switched to the arc between the stationary contact members 102 and the movable contact member 201 through the arc runner 1. Further, the distance L4 becomes longer than the distance L2, the arc cannot take place between the garter spring 103 and the coil bobbin 2 or between the stationary contact members 102 and the coil bobbin 2.

When the distance L1 between the stationary contact members 102 and the rising portion 11*b* of the arc runner 1 is shorter than the above-mentioned distance L2, the arc takes place between the stationary contact members 102 and the movable contact member 201 through the arc runner 1, while an arc does not occur between the stationary contact members 102 and the coil bobbin 2. Since the distance L3 between the rising portion 11*b* of the arc runner 1 and the movable contact member 201 is shorter than the distance L1, the arc can be smoothly and certainly switched to one which occurs between the arc runner 1 and the movable contact member 201, so that extinguishment of the arc can be facilitated.

(Other Embodiments of the Present Invention)

In the above-mentioned embodiment, the relative arrangements between the arc runner 1 and the stationary contact members 102 and between the arc runner 1 and the movable contact member 201 are defined. In addition to the above relative arrangements, it is possible to define relative arrangements between the stationary contact member 102 and the driving coil 3 and the arc runner 1 and the central guide part 104.

In the above-mentioned embodiment, the magnetic blow-out function due to the driving coil 3 is used to extinguish the arc. Alternatively, it is possible to employ an extinguishing means by blowing an extinguishing gas or oil against the arc so that a gas or oil at a high temperature can be urged to be blown out or to employ an extinguishing means which utilizes a physical effect such as a pressure applying extinguishment, a diffusing extinguishment or a replacing extinguishment.

According to the present invention, the following advantages can be obtained. The arc runner has a cylindrical shape and includes a rising portion formed on an entire inner circumference of the cylindrical shape. A slant angle of the rising portion obtained on the depth side thereof is greater than another slant angle thereof obtained on the front side thereof. Hence, it is possible to certainly alter the arc occurring between the two contact parts to an arc occurring between the arc runner and the other one of the two contact parts. Hence, the arc can be certainly extinguished more rapidly.

The distance between the above one of the two contact parts and the arc runner is shorter than the distance between the above one of the two contact parts and an inner wall of the coil bobbin. Hence, it is possible to facilitate shifting of the arc toward the arc runner.

The distance between a top of the rising portion of the arc runner and the other one of the two contact parts located in the cylindrical body of the arc runner when the contact made by the two contact parts is closed or opened is shorter than the distance between the above one of the two contact parts and the arc runner. Hence, it is possible to facilitate shifting of the arc toward the arc runner.

The arc runner has a corner located on a side of an outer circumference thereof. The above corner prevents the arc from being spread. Particularly, when a plurality of phases are serially disposed, the intervals can be reduced and down-sizing of the device can be achieved.

The front slant of the arc runner defined by the rising portion is parallel to the direction of a magnetic flux generated by the driving coil. Hence, it is possible to operate the maximum electromagnetic force in the direction perpendicular to the arc of the arc runner.

The above one of the two contact parts comprises contact members arranged in the tulip formation so as to form a hollow cylindrical shape. The arc extinguishing device further comprises a central guide part arranged in the hollow cylindrical shape of the above one of the two contact parts and attached to the base of the above one of the two contact parts, the central guide part being formed of a magnetic member coated by an insulating member. Hence, it is possible to certainly perform the closing and opening operations and concentrate the magnetic flux generated by the driving coil on the magnetic central guide part. As a result, the arc can be smoothly guided toward the central guide part from the other contact part.

The central guide part comprises a conical shape located at an end thereof, and the conical shape may have a slant surface Lo which a line parallel to a front slant of the arc runner defined by the rising portion. Hence, it is possible to more certainly draw the magnetic field generated by the driving coil toward the-central guide part and to thus perform the arc extinguishing function more certainly.

What is claimed is:

1. An arc extinguishing device of a circuit breaker which closes and opens an electric line comprising:

first and second contact parts fixed to a base part, an arc runner formed from electrically conductive material an arranged on an outer periphery of one of said first and second contact parts, wherein said arc runner includes a generally cylindrical shape having inner portions which define an opening of said cylindrical shape, wherein said opening is defined by first and second slant angles, wherein said first slant angle is greater than said second slant angle.

2. The arc extinguishing device as claimed in claim 1, further including a coil bobbin, wherein the coil bobbin is arranged on one of said first and second contact parts, and wherein said bobbin is disposed relative to said first and second contact parts such that the closest distance between said first contact part and said bobbin is greater than the closest distance between said second contact part and said arc runner.

3. The arc extinguishing device as claimed in claim 2, further including a driving coil disposed in said bobbin, wherein said first slant angle of the arc runner is generally parallel to a direction of a magnetic flux generated by the driving coil.

4. The arc extinguishing device as claimed in 1, wherein a distance between a top of the rising portion of the arc runner and the other one of the two contact parts located in the cylindrical body of the arc runner when the contact made by the two contact parts is closed or opened is shorter than the distance between said one of the two contact parts and the arc runner.

5. The arc extinguishing device as claimed in 1, wherein:

said one of the two contact parts includes contact members arranged in a tulip formation so as to form a hollow cylindrical shape;

the arc extinguishing device further comprises a central guide part residing in an opening of said second contact part and attached to a base of said first contact part, said central guide part being formed of a magnetic member coated by an insulating member.

6. The arc extinguishing device as claimed in claim 5, wherein the central guide part comprises a conical shape located at an end thereof, said conical shape having a slant surface which is parallel to said first slant angle of the arc runner.

7. The arc extinguishing device as claimed in claim 1, wherein a front slant of an arc runner defined by a rising portion is parallel to a direction of a magnetic flux generated by a driving coil.

* * * * *